US007744443B2

(12) United States Patent
Cassidy

(10) Patent No.: US 7,744,443 B2
(45) Date of Patent: Jun. 29, 2010

(54) TOY GRILLING APPARATUS

(75) Inventor: Paul M. Cassidy, Blackpool (GB)

(73) Assignee: Cassidy Brothers PLC, Blackpool (GB)

( * ) Notice: Subject to any disclaimer, the term of this patent is extended or adjusted under 35 U.S.C. 154(b) by 0 days.

(21) Appl. No.: 12/426,514

(22) Filed: Apr. 20, 2009

(65) Prior Publication Data

US 2009/0325462 A1 Dec. 31, 2009

(30) Foreign Application Priority Data

Jun. 26, 2008 (GB) ..... 0811737.6

(51) Int. Cl.
*A63H 33/30* (2006.01)

(52) U.S. Cl. ..... 446/481; 446/479; 446/397

(58) Field of Classification Search ..... 446/24, 446/71, 73, 76, 397, 475, 479, 481; 219/386, 219/411

See application file for complete search history.

(56) References Cited

U.S. PATENT DOCUMENTS 3,368,063 A * 2/1968 Kuhn ..... 219/411
3,808,730 A * 5/1974 Cooper et al. ..... 446/481
5,306,192 A * 4/1994 Caveza et al. ..... 446/71
6,450,851 B1 9/2002 Rehkemper et al.

* cited by examiner

*Primary Examiner*—Nini Legesse
(74) *Attorney, Agent, or Firm*—Stites & Harbison PLLC; Douglas E. Jackson

(57) ABSTRACT

The invention relates to a toy grilling apparatus. The apparatus includes a grill base, a grill lid, and a reservoir. The grill base has a grilling surface. The grill lid and the grill base are movable relative to one another to be brought together into a grilling arrangement. The reservoir is capable of retaining fluid. When the grill base and the grill lid are in the grilling arrangement, fluid is able to be expelled from the reservoir to flow on the grilling surface.

19 Claims, 9 Drawing Sheets

TOY GRILLING APPARATUS

The present invention relates to a toy grilling apparatus, particularly, but not exclusively, to a toy grilling apparatus provided with a means for retaining a fluid, e.g. a reservoir, where fluid is expellable from the reservoir to flow on a grilling surface of the toy grilling apparatus.

In recent years grilling apparatuses such as, amongst others, the George Foreman® Lean Mean Fat Reducing Grilling Machine have become popular.

Such grilling apparatuses are often formed of a clam-shell design having a base including a lower grilling surface and a lid having an upper grilling surface. The base and lid are often mutually coupled by a hinge to allow the base and lid to be brought together e.g. to "sandwich" a food item placed between them.

Such grilling apparatuses are sometimes referred to as health grills, and are purportedly "healthy" because they often have ridges formed at least on the grilling surface of the base, so that during grilling a food item does not sit in fat (and/or its own juices). Other grilling apparatuses referred to as health grills are purportedly healthy because the grilling surface (of at least the base) is configured to be at an incline relative to a surface on which the grilling apparatus is arranged. As a result of this configuration, fats and/or juices rendered from a food item as it is grilled can "run off", e.g. flow off, the grilling surface(s) so that the food item is not sitting in them for the duration of the cooking.

A child who wants to mimic a parent grilling food on a grilling apparatus, e.g. a health grill, can use a toy barbecue (BBQ) type grill. However, this is not satisfactory for the child, because the toy BBQ grill does not provide the same sensations for the child as a real grilling apparatus does for the parent. In particular, toy BBQ grills do not give the perception that fat and/or juices are rendered from a (toy) food item when it is "grilled".

Accordingly, the present invention aims to solve the above problems by providing a toy grilling apparatus according to claim 1, whereby a (child) user perceives the fluid flowing on the grilling surface to correspond to the fat and/or juices rendered from a food item grilled on a real grilling apparatus (e.g. by his or her parent). Accordingly, the (child) user is given the sensation that a (toy) food item grilled on the toy grilling apparatus renders e.g. fat and/or juices whilst being grilled.

Here, the term reservoir is intended to convey the concept of a means capable of retaining an amount of a fluid, e.g. a liquid, preferably water. For example, the reservoir could be a chamber or vessel capable of retaining the fluid. The vessel may have a floor and one or more walls for defining a fluid retaining volume, for example. On the other hand, the reservoir could be a body formed of a material suitable for absorbing and retaining the fluid. For example, the body could be formed of a sponge-like material, e.g. cellulose sponge, foam spong or natural (sea) sponge.

The term toy grilling apparatus should be interpreted as covering a range of toy apparatuses which correspond to real grilling apparatuses. For example a toy grilling apparatus according to the present invention may be a toy health grill, which is of a clam-shell design as described above. The toy grilling apparatus may be a toy worktop grilling apparatus, e.g. a toy worktop health grill, such that the toy worktop grilling apparatus resembles a worktop grilling apparatus, intended to be used e.g. on a domestic worktop.

Preferably, the reservoir includes a fluid retaining vessel, at least partly defined by a plurality of vessel walls.

The fluid retaining vessel may be detachably couplable to the grill lid. The fluid retaining vessel may be detachably couplable to the grill base. This allows the vessel to be easily refilled with e.g. water from a tap.

The fluid retaining vessel may be formed integrally with the grill lid. The fluid retaining vessel may be formed integrally with the grill base. This provides a safeguard against the reservoir, e.g. a vessel being lost, and can also provide a safeguard against the reservoir, e.g. the vessel, acting as a choke hazard to a young child.

Preferably, expelling means are included for urging fluid in the reservoir, e.g. the vessel, to be expelled. The expelling means may be operable only when the grill lid and grill base are in the grilling arrangement.

The expelling means may include pumping means operable to pump fluid from the reservoir, the fluid thereby being expelled from the reservoir (e.g. the vessel) to flow on the grilling surface. Preferably, the pumping means is operable to pump fluid from the reservoir only when the grill lid and base are in the grilling arrangement. The pumping means may include an electric pump.

The expelling means preferably may include volume reducing means for reducing a fluid retaining volume of the reservoir, e.g. the vessel, thereby to urge fluid in the reservoir, e.g. the vessel, to be expelled from it. For example, the volume reducing means may include a plunger movable within the reservoir, e.g. the vessel, to urge fluid in the reservoir, e.g. the vessel, to be expelled.

The plunger may be associated with the grill lid and/or the grill base such that relative movement of the grill lid and grill base into the grilling arrangement results in a corresponding movement of the plunger to urge fluid in the reservoir, e.g. the vessel, to be expelled.

Preferably, the plunger is directly movable within the reservoir, e.g. the vessel, by a user to urge fluid in the reservoir, e.g. the vessel, to be expelled.

Preferably, the volume reducing means includes a compressible member, wherein compression of the compressible member is capable of urging fluid retained within the reservoir, e.g. the vessel, to be expelled from the reservoir, e.g. the vessel. For example, the compressible member may form at least a portion of the floor and/or one or more walls of a vessel acting as the reservoir, thus compression of the compressible member, e.g. by a user, may directly lead to the fluid retaining volume of the vessel being reduced sufficiently to urge fluid in the vessel to be expelled. The compressible member may be arranged to be compressed by one or more portions of the grill lid and/or grill base when putting the grill base and grill lid into the grilling arrangement. For example, the compressible member may be associated with the grill lid and/or the grill base such that relative movement of the grill lid and grill base, e.g. into the grilling arrangement, results in a corresponding compression of the compressible member to urge fluid in the reservoir to be expelled.

The reservoir may include a compressible body capable of retaining fluid, wherein compression of the compressible body urges fluid held in the compressible body to be expelled therefrom. The compressible body is preferably formed of a material capable of absorbing a fluid, e.g. a liquid, suitable for a child to play with, i.e. preferably water, and preferably the material allows the fluid to be easily expelled. Preferably, the material returns to its original state after having absorbed and then expelled a fluid. Preferably, the material is a sponge-like material. The (absorbent) compressible body may be shaped to resemble a food item, e.g. a fish, a burger, a sausage, a cob of corn, a tomato, an egg, a slice of bacon, a hash brown, a steak or a chop, for example.

Preferably, the (absorbent) compressible body is locatable between the grill base and grill lid to rest on the grilling surface of the grill base. Compression of the compressible body between the grill lid and the grill base, e.g. when they are put in the grilling arrangement, preferably urges fluid (previously absorbed into the compressible body) to be expelled from the compressible body to flow on the grill base grilling surface.

The (absorbent) compressible body may be provided as a grilling ridge on a grilling surface of the grill base or the grill lid. Preferably, one or more such compressible bodies are provided, on each of the grill lid and the grill base. Even more preferably, a plurality of such compressible bodies is provided on the grill lid and/or the grill base.

At least a portion of the grilling surface of the grill lid and/or the grill base may include an (absorbent) compressible body for retaining a fluid, compression of such a body urging the fluid to be expelled from it.

The (absorbent) compressible body may not be intended to be located between the grill base and grill lid to be sandwiched by them. For example, the compressible body may be receivable in the grill base to be sandwiched between a grill base floor and a grill base grilling body which includes the grilling surface, the grill base grilling body being movable relative to the grill base floor to compress the compressible body. The grill base grilling body may only be movable relative to the grill base floor when the grill base and the grill lid are in the grilling arrangement The compressible body may be receivable in the grill lid to be sandwiched between a grill lid ceiling and a grill lid grilling body which includes a grill lid grilling surface, the grill lid grilling body being movable relative to the grill lid ceiling to compress the compressible body. The grill lid grilling body may only be movable relative to the grill lid ceiling when the grill base and the grill lid are in the grilling arrangement.

Means may be provided for conveying fluid expelled from the reservoir to flow at least on the grill base grilling surface. The means may not deliver a fluid directly to the grilling surface, for example, the means may deliver the fluid to one or apertures, for example, formed in the grill lid, whereby the fluid is able to drip onto the grill base grilling surface to flow on it.

For example, a first conduit via which fluid in the reservoir can be communicated to the grilling surface may be provided.

The first conduit preferably includes one or more apertures formed in the grill lid for communicating the fluid to the grill base grilling surface.

The grill base is preferably configured to provide a second, e.g. an alternative or an additional, conduit via which fluid in the reservoir can be communicated to the (grill base) grilling surface.

The or each conduit preferably includes one or more apertures formed in the grill base for communicating the fluid to the grilling surface. The or each aperture is preferably formed in the grilling surface.

A valve for controlling the flow of fluid from the reservoir to the grilling surface via the first and/or second conduit is preferably provided. The or each valve is preferably capable of preventing the flow of fluid from the reservoir to the grilling surface via the respective conduit when the grill base and the grill lid are in an arrangement other than the grilling arrangement.

The or each valve preferably includes a check valve, operable to allow fluid from the reservoir to be communicated via the respective conduit to the grilling surface when the fluid pressure on the upstream reservoir side of the check valve exceeds the pressure on the downstream side of the check valve by a pre-determined amount.

The grill base grilling surface is preferably configured to be arranged at an incline to a level surface when the toy grilling apparatus is arranged on the level surface, thereby urging fluid flowing on the grilling surface to flow in a particular direction.

The grill base may include one or more support elements for supporting the toy grill on the level surface, wherein the grilling surface and the one or more support elements are mutually configured such that when the toy grill is arranged on the surface, the grilling surface is inclined relative to the level surface. Preferably, the one or more support elements are adjustable to adjust the degree of inclination of the grill surface. A rotatable cam may be provided, rotation of the cam being capable of adjusting the degree of inclination of the grill surface.

Means for generating sound simulating the sound of grilling food may be provided. The sound generating means may be configured to be operable to generate sound contemporaneously with fluid from the reservoir flowing on the grilling surface.

A toy grilling apparatus according to the present invention is preferably a toy health grilling apparatus, e.g. a toy health grill.

A toy grilling apparatus according to the present invention may include, e.g. for supporting the grill base and grill lid, one or more support elements having a wheel, e.g. a castor, for facilitating easy movement of the toy grilling apparatus. The support elements may each have a length which is larger than the height of the grill base and/or grill lid, preferably of the grill base and grill lid, even more preferably of the grill base and grill lid when they are not in the grilling arrangement.

Another aspect of the present invention aims to provide a kit of parts, as set forth in the claims.

In another aspect, the present invention provides a toy grilling apparatus having a cooking surface (e.g. similar to the grill base grilling surface of the aspects described above, which cooking surface may include any one or more of the features described as being a feature, e.g. a preferred or optional feature, of the grill base grilling surface described herein); and a reservoir capable of retaining fluid; wherein fluid is able to be expelled from the reservoir to flow on the cooking surface.

The cooking surface may be movable to expel fluid from the reservoir. The reservoir may be in fluid communication with one or more apertures formed in the cooking surface. Movement of the cooking surface may urge fluid in the reservoir to be expelled to flow on the cooking surface via the or each aperture.

The cooking surface may be provided in the form of one or more grilling bars, similar to that provided with a BBQ. A toy grilling apparatus according to the present invention may be a toy BBQ.

Any feature associated with the other aspects of the present invention may be incorporated into a toy grilling apparatus according to the present aspect. In particular, the cooking surface may be inclined as described above. A drip collection means may be provided at a region of the cooking surface towards which fluid will flow when the toy grilling apparatus is arranged on a level surface, the drip collection means preferably being arranged to collect at least a fraction of a volume of fluid flowing on the cooking surface.

A toy grilling apparatus according to any aspect of the present invention may include a rotisserie assembly for spit roasting a toy food item, such as a chicken, a suckling pig etc. adjacent to, e.g. over, one or more grilling surfaces. The rotisserie assembly may include drive means for rotating a spit on which a toy food item is arrangeable to be rotated. The drive means may include a motor, e.g. an electric motor for rotating the spit. The drive means may include a crank, movable by a user, e.g. a child, to rotate the spit. The drive means may be in communication with the reservoir, such that driving the drive means to rotate the spit urges fluid in the reservoir to be expelled from it to flow on at least one of the one or more grilling surfaces. As such, the reservoir may include means for urging the fluid to be expelled from it, e.g. a pump, such as an electrical pump.

The present invention will now be disclosed by way of example only, with reference to the accompanying figures, in which.

EXAMPLE 1

Figure 1B:
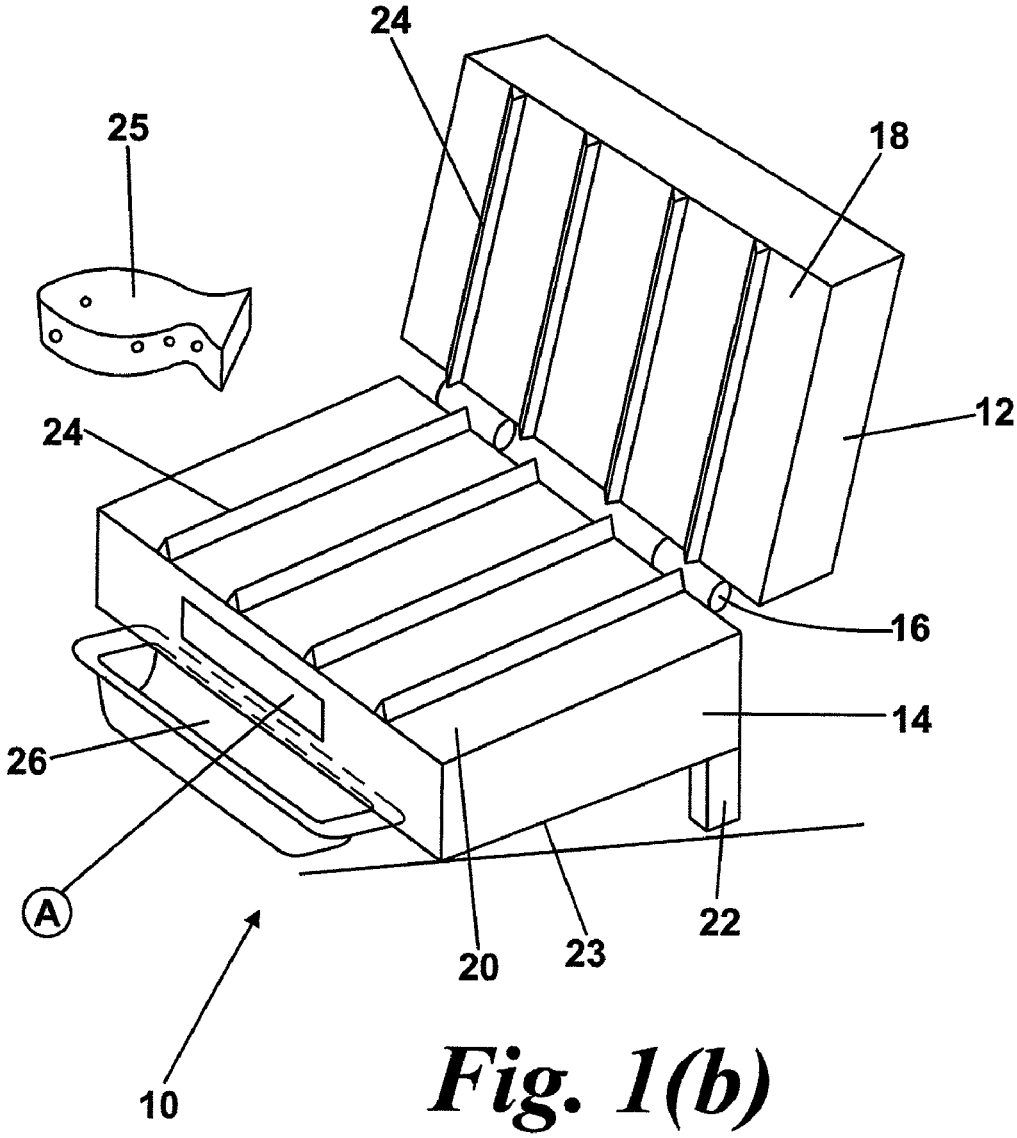
FIG. 1 shows a combination of two embodiments of the present invention.
Figure 1A:
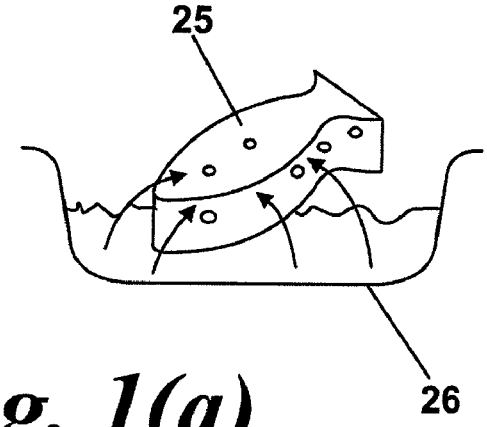

In FIG. 1 a toy grilling apparatus 10 according to the present invention is shown. The toy grilling apparatus 10 can be considered to be a toy health grill type of toy grill.

The toy grilling apparatus 10 includes a grill lid 12 and a grill base 14 coupled together by a hinge 16 to allow the lid to be closed over the base 14.

The lid 12 may have a grilling surface 18. The base 14 has a grilling surface 20. Preferably, the grilling surface 20 is arrangeable to be at an incline e.g. relative to a level surface on which the grilling apparatus 10 is arranged.

For example, a simple way to achieve this is to place a leg 22 at each of the "rear" corners of the base 14. By providing no legs at the corresponding "front" corners (or by providing shorter legs at the front corners than at the rear corners) when the toy grilling apparatus 10 is placed on a level surface, the grilling surface 20 should be inclined relative to the level surface. Of course, other means may be provided to obtain such an incline. For example, the base itself may be wedge-shaped so that the grilling surface 20 is at an incline angle relative to a lower most surface 23 of the base of the toy grilling apparatus.

The grilling surfaces 18 and/or 20 may include grill ridges 24 (or grill "fins") projecting from a surface of the grill surface 18 and/or 20. Toy food items placed on a grill surface including such ridges will tend to rest on the ridges.

The ridges may be provided at a constant height, for example relative to the recessed portion(s) of the grilling surface located between the grilling ridges, thus the ridges may incline relative to the level surface referred to above by the same angle as the recessed portion(s).

Alternatively, for example, the grilling ridges may be provided so that they incline at a different angle.

Indeed, the grilling ridges may be provided to be substantially parallel to the level surface, whilst the recessed portion(s) is/are at an incline as previously described. This has the advantage that toy food item can be held in place, without tending to slide down the ridges, whilst fluid can still flow down the inclined recessed portion(s), as described below.

A means of retaining a fluid, e.g. a liquid, for example water, is provided. For example, such means may be provided in the form of an absorbent, e.g. sponge-like, item of food 25 intended to be placed between the grill lid 12 and grill base 14, e.g. initially to be placed on the grilling surface 20.

Figure 2B:
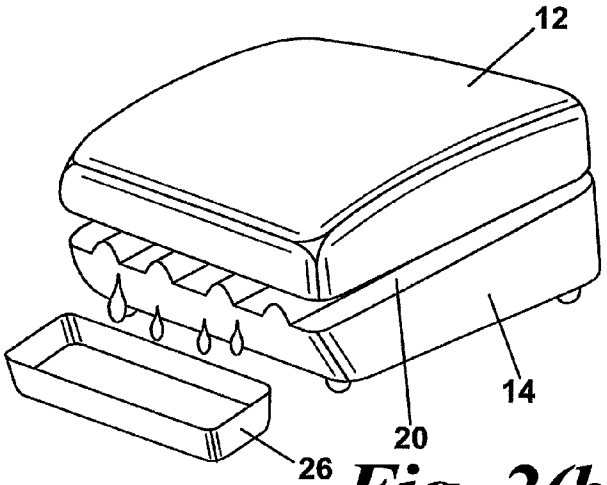
FIG. 2 shows in more detail one of the embodiments of the present invention shown in FIG. 1.
Figure 2C:
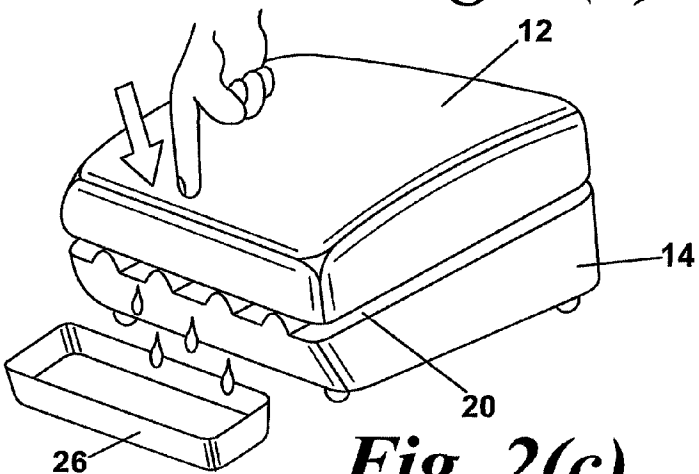
Figure 2A:
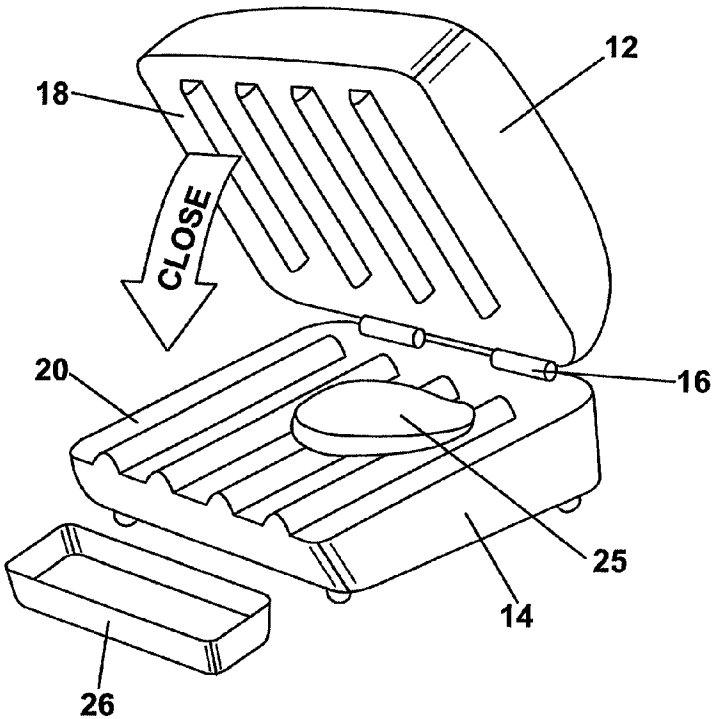

It is intended that a (child) user is provided with the toy food item 25 when it has absorbed the fluid. The child can do this for himself or herself, or alternatively a parent could do this. The food item, retaining the fluid, is then intended to be placed on the grilling surface 20, for example as shown in FIG. 2(*a*).

The (child) user can then close the lid 12 over the base 14 to sandwich the toy food item 25 between the upper grilling surface 18 and the lower grilling surface 20.

It is envisaged, in an embodiment, that the mass of the lid 12 is sufficient to expel fluid from the reservoir, e.g. to squeeze liquid from the food item 25 such that the liquid flows on the lower grilling surface 20 and runs off, e.g. drips off, the lower grilling surface 20. This feature may be included in an embodiment according to the present invention. Therefore, the child user perceives that the grilled food item has rendered fat and/or juice because it is "being grilled" by the toy grilling apparatus.

In another embodiment, it is envisaged that it will be necessary for a user actively to urge the lid 12 towards the base 14 in order to expel fluid from the reservoir, e.g. by squeezing liquid out of the toy food item 25. This feature may be included in any embodiment according to the present invention. The liquid is caused to flow on the lower grilling surface 20 and to run off, e.g. drip off, the lower grilling surface 20.

Accordingly, a toy grilling apparatus according to the present invention may also be provided with a drip collection tray 26 positionable beneath drip portion of the grilling surface 20 to collect fluid, e.g. water, dripping off the grilling surface.

EXAMPLE 2

In another embodiment, generally conforming to the example shown in e.g. FIGS. 1 and 2, the grill ridges 24 themselves may be formed of an absorbent material, e.g. a sponge-like material, suitable for absorbing a fluid, e.g. a liquid, for example water. Thus, the grill ridges 24 can act as one or more reservoirs. Compression of these one or more reservoirs can expel fluid retained within them.

Thus, placing a toy food item 25, which may or may not itself be made of an absorbent compressible material, between the grill surfaces 18 and 20 and subsequently closing the lid 12 onto the base 14, preferably results in compression of one or more of the grill ridges 24 to expel liquid from them such that it flows on the lower grilling surface 20.

In a modification of this embodiment, the entire grilling surface of the grill base and/or the grill lid may be formed of an absorbent compressible material as described above.

EXAMPLE 3

In a modification of the toy grilling apparatus 10 shown in FIG. 1, the base 14 may include a chamber (not shown) for receiving the means for retaining fluid, wherein the means for retaining fluid is preferably other than the toy food item 25 intended to be sandwiched between the lower grilling surface 20 and the upper grilling surface 18.

The means for retaining fluid, e.g. the reservoir, may nonetheless be an absorbent, e.g. sponge-like, material, which when compressed is caused to expel an amount of fluid originally retained within it. For example, the base 14 may include a slot A, e.g. in a side face or a front or rear face of the base 14, via which the reservoir can be located in the chamber preferably beneath the lower grilling surface 20 (when in use). Such a slot and chamber could alternatively, or additionally, be formed in the grill lid 12 for receiving such a reservoir, preferably above the grilling surface 18 (when in use). The following discussion relates to the grill base 14, but the comments are equally applicable to the grill lid 12.

Thus, the grilling surface 20 may be movable relative to the grill base 14 to compress the reservoir located in the chamber, e.g. against a floor of the chamber formed in the base 14. The chamber in the base 14 may be in fluid communication with the grilling surface 20 such that compression of the reservoir within the chamber causes fluid retained by the reservoir to flow on the grilling surface 20. For example, a number of apertures may be formed in the grilling surface 20. These apertures may allow fluid urged, e.g. expelled, from the reservoir to be communicated to the grilling surface 20 to flow thereon.

Such a slot A and chamber may be provided in each of the lid and base or only one of them.

In this embodiment, it is intended that the food item 25 be sufficiently resilient to deformation such that when it is placed on the lower grilling surface 20, e.g. as shown in FIG. 2(*a*), and the lid is subsequently closed, the food item helps to urge the lower grilling surface 20 to move relative to the floor of the base 14.

EXAMPLE 4

Figure 3B:
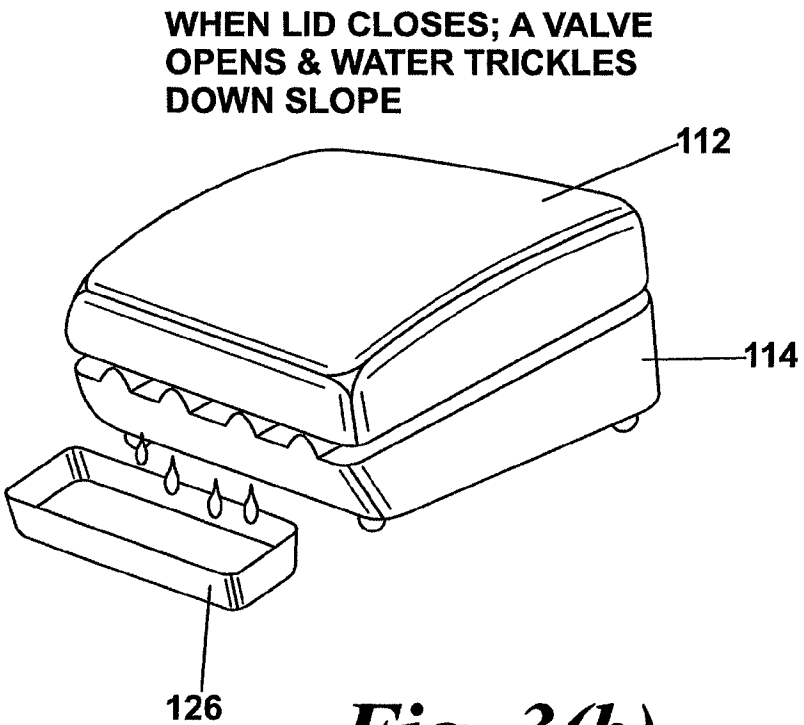
FIG. 3 shows a toy grilling apparatus according to the present invention.
Figure 3A:
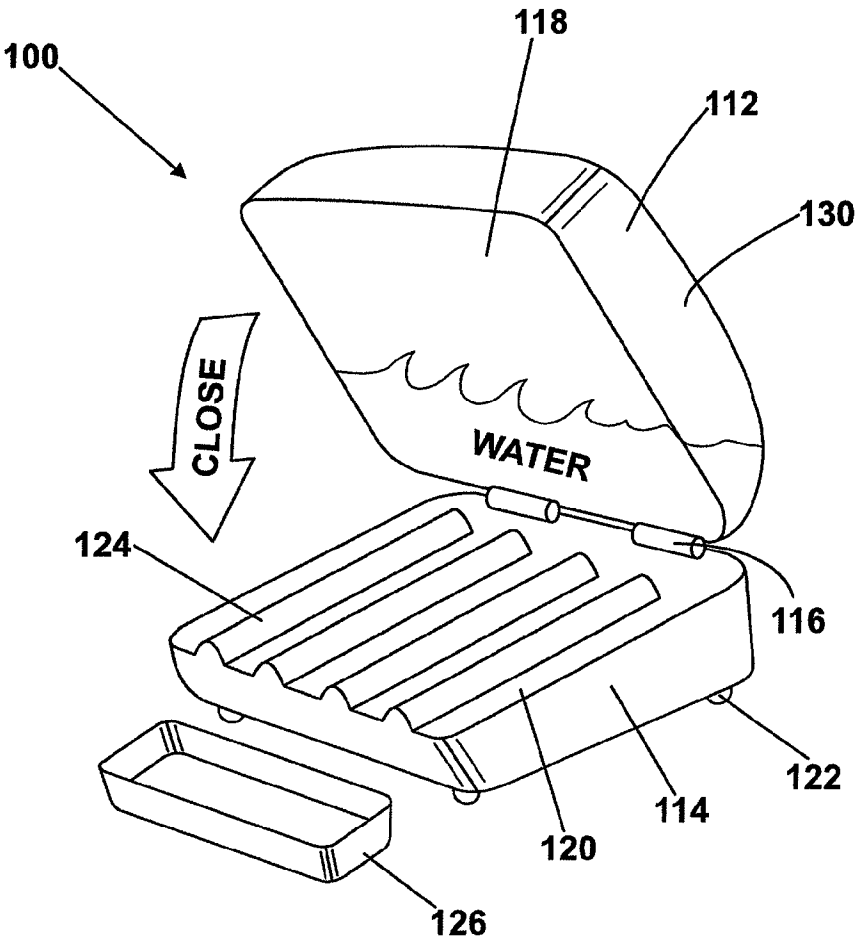

In other embodiments, for example such as the one which is to be described now, the means for retaining the fluid, e.g. a reservoir, may well be in the form of a vessel rather than an absorbent body, such as the absorbent toy food item 25. Looking at FIG. 3, a toy grilling apparatus 100 is shown having a lid 112 and a base 114 coupled to one another by one or more hinges 116, generally similar to that described in relation to FIGS. 1 and 2.

The base 114 has a grilling surface 120 and the lid may have a grilling surface 118 and either or both of these grilling surfaces may include grilling ridges 124.

The lid 112 may be modified to include a fluid retaining reservoir in the form of the vessel or chamber 130. Such a vessel or chamber 120 may be located within the lid 112. The vessel 130 is preferably configured to retain the fluid within itself when the lid 112 and base 114 are not in the grilling arrangement. However, when the lid 112 and base 114 are arranged in the grilling arrangement such that the upper grilling surface 118 and the lower grilling surface 120 are brought together, the fluid retained within the vessel 130 is able to be communicated to the lower grilling surface 120 to flow thereon.

For example, one or more apertures may be provided in the lid 112 to be in fluid communication with the vessel to permit the fluid to be communicated to the lower grilling surface 120. A valve is preferably provided to control communication of fluid in this way. The valve may only be openable when the lid 112 and the base 114 are in the grilling arrangement. Preferably, the valve is open when the lid 112 and the base 114 are in the grilling arrangement.

Again, the toy grilling apparatus is preferably configured such that when it is arranged on a level surface, the grilling surface 120 is at an incline to said level surface.

Figure 4:
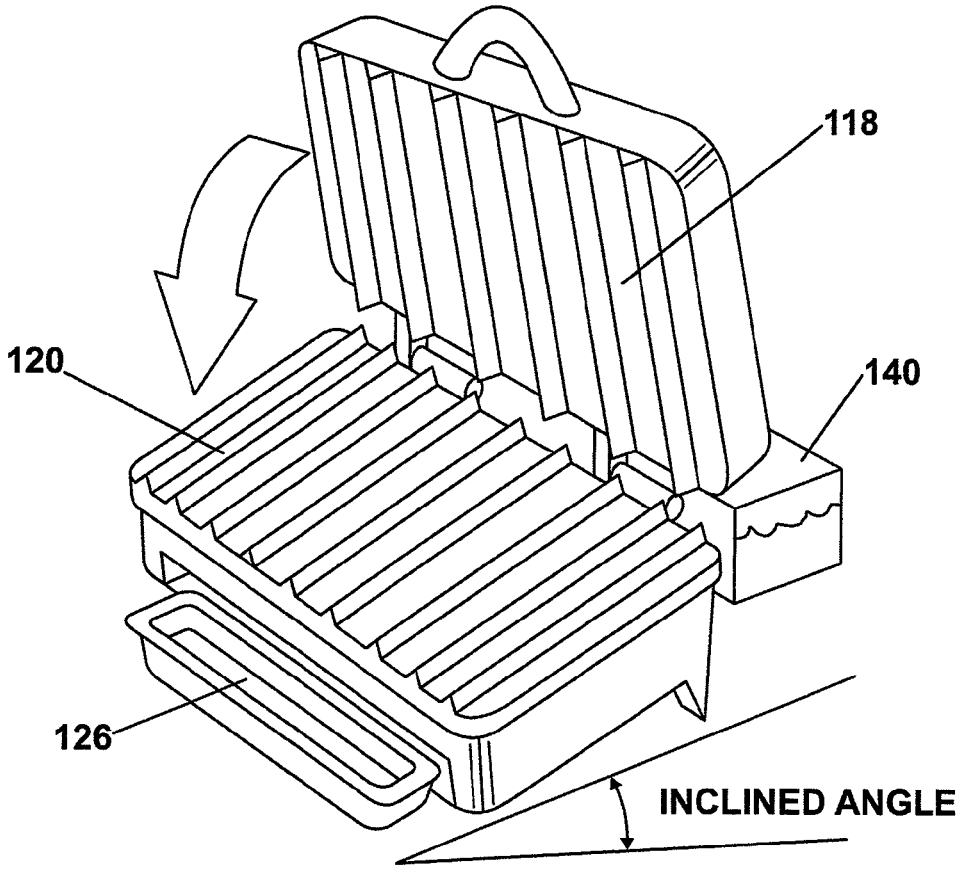
FIG. 4 shows another toy grilling apparatus according to the present invention, and shows in particular the desirable inclination of the grill base grilling surface.
Figure 4:
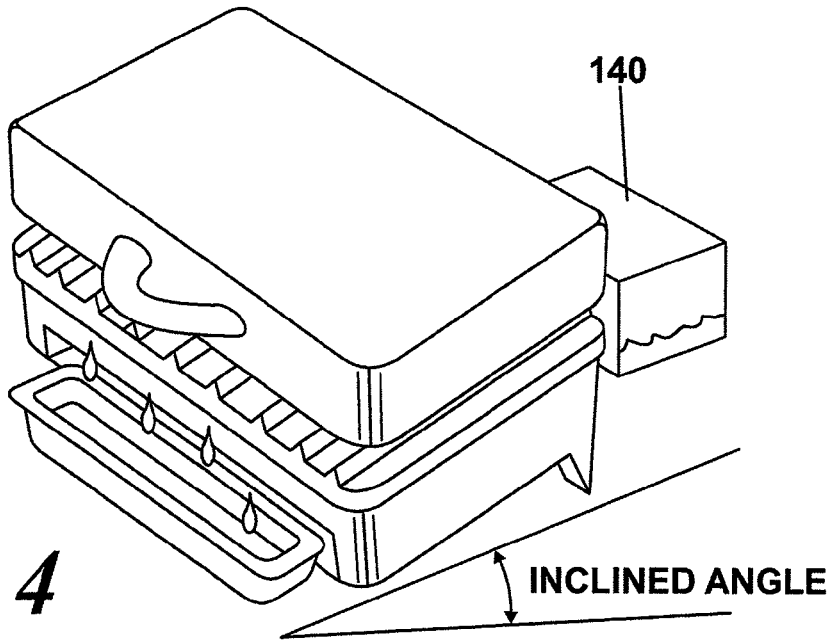

As shown in FIG. 4, the fluid retaining means, e.g. the vessel, may be provided externally to the lid and/or base. The vessel is preferably detachable from the toy grilling apparatus, so as to be easily refillable.

Figure 5:
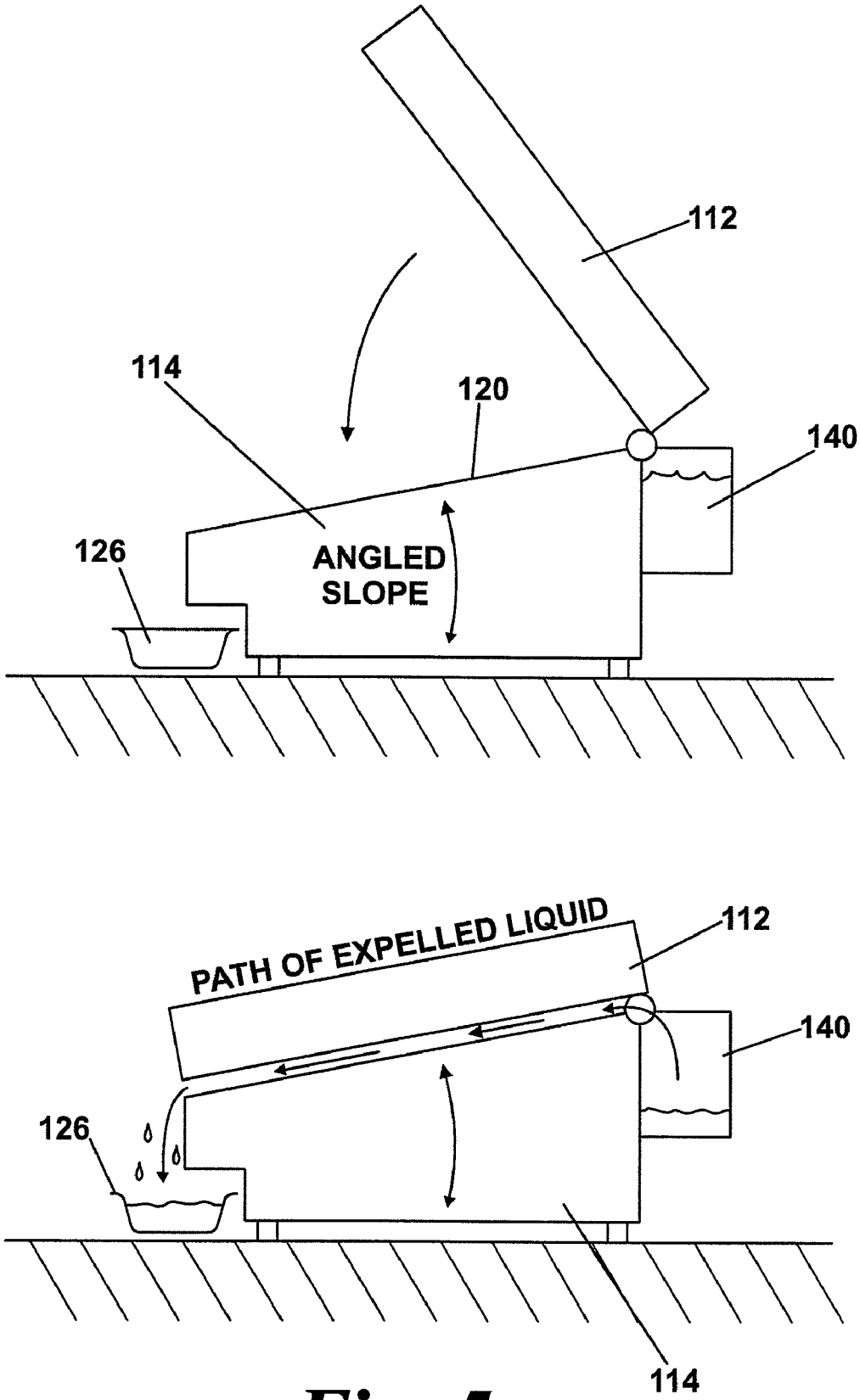
FIG. 5 shows another toy grilling apparatus according to the present invention, and shows an alternative means for inclining the grill base grilling surface.

As shown in FIG. 5, for example, the action of closing the lid onto the grill base may cause fluid to leave, e.g. to be expelled from, the vessel 140 and to travel down the slope provided by the grilling surface 120 on the base 114. Closing the lid in such a way may move a plunger, for example, to urge fluid out of the vessel 140.

A skilled person is aware of other means for urging fluid from a vessel, e.g. pressure increasing means may be in communication with the lid and/or base such that when the lid and base are moved into the grilling arrangement, the pressure increasing means may increase the pressure of the fluid in the vessel causing it to be expelled therefrom.

EXAMPLE 5

Figure 6A:
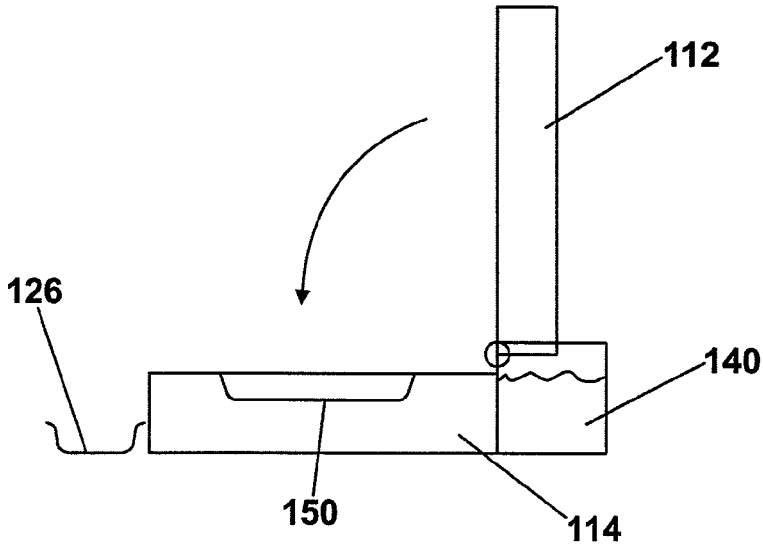
FIG. 6 shows a toy grilling apparatus according to the present invention.
Figure 6B:
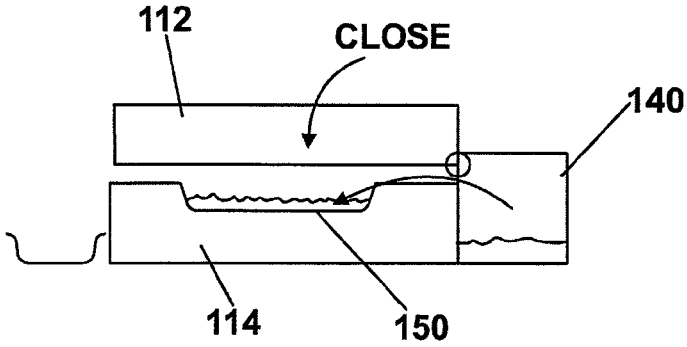
Figure 6C:
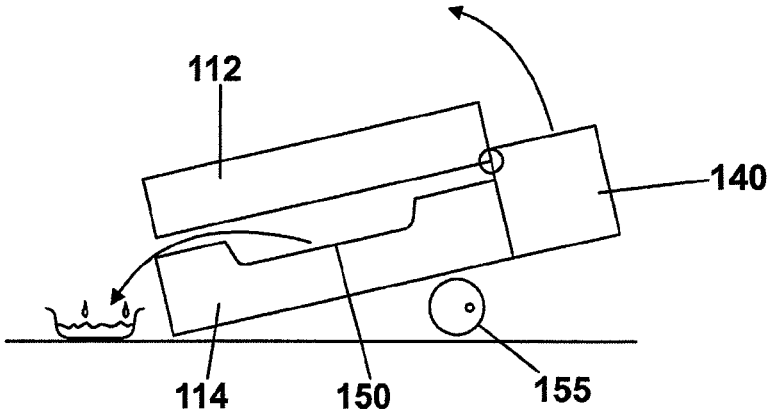

In another configuration according to the present invention, the base 114 may include a collection dish, e.g. a recess, for receiving fluid from a vessel 140. In the open arrangement e.g. shown in FIG. 6(*a*), the collection dish 150 is preferably formed integrally with the base 114.

When the toy grilling apparatus is in the open arrangement, the vessel 140 is preferably prevented from expelling fluid into the collection dish 150. However, when the toy grilling apparatus is in the grilling arrangement, as shown for example in FIG. 6(*b*), expelling means (not shown) urge fluid retained within the vessel 140 to be communicated into the collection dish 150. As this urging preferably only takes place when the toy grilling apparatus is in the grilling arrangement, a (child) user may not be acutely aware of this communication of the fluid.

When the toy grilling apparatus is arranged in the grilling arrangement, a user can "turn on" the toy grilling apparatus to "begin grilling" a food item, for example, placed between the lid 112 and the base 114. In so doing, means for tilting the grill base grilling surface may be operated, for example a cam 155 may be rotatable to tilt the toy grilling apparatus as whole, thus tilting the grilling surface, such that the fluid held in the collection dish 150 is urged to flow out of the collection dish 150 via the grilling surface (the grilling surface not being shown in FIG. 6 for clarity).

PREFERRED EXAMPLE

Figure 7:
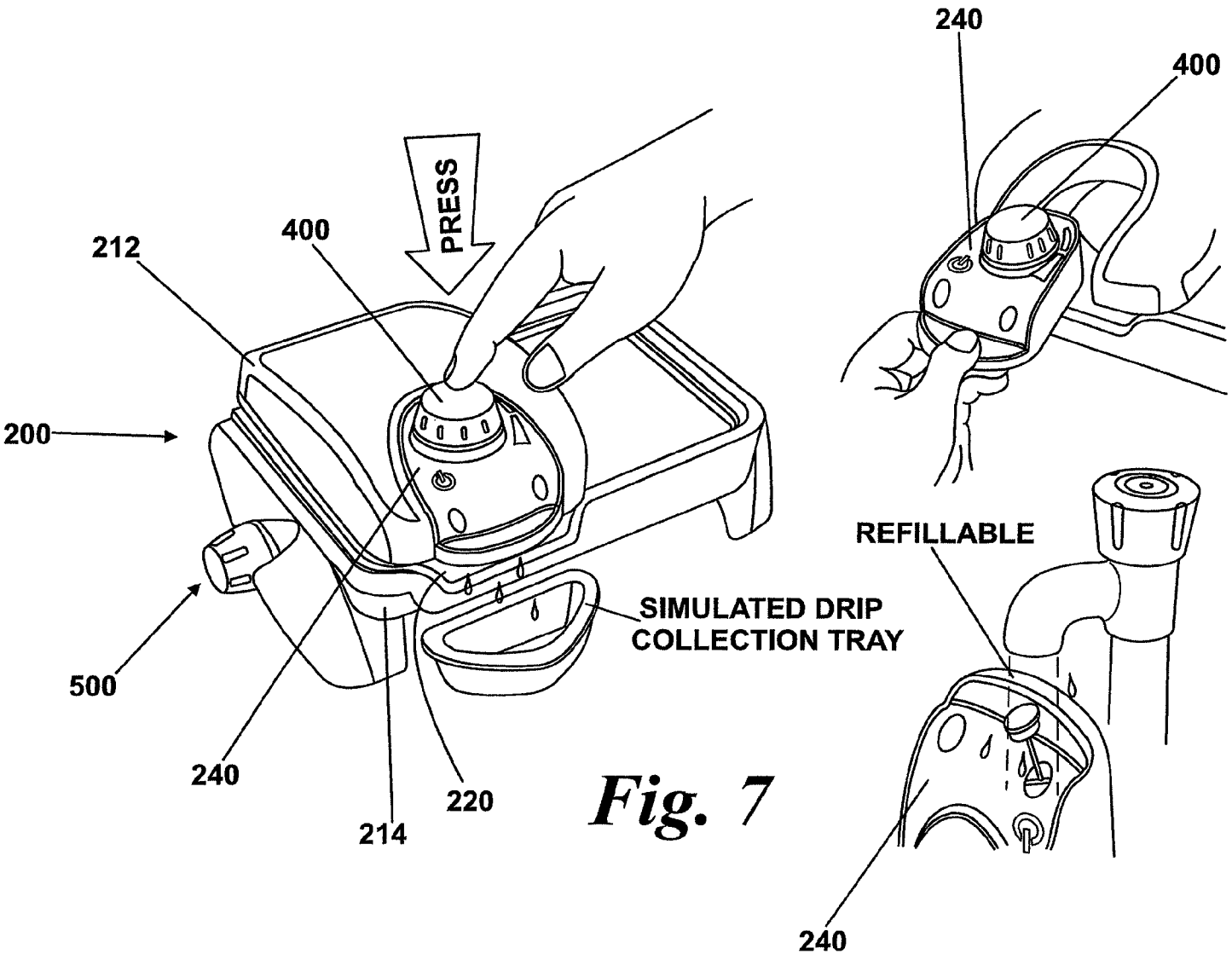
FIG. 7 shows a preferred toy grilling apparatus according to the present invention in the grilling arrangement.
Figure 8:
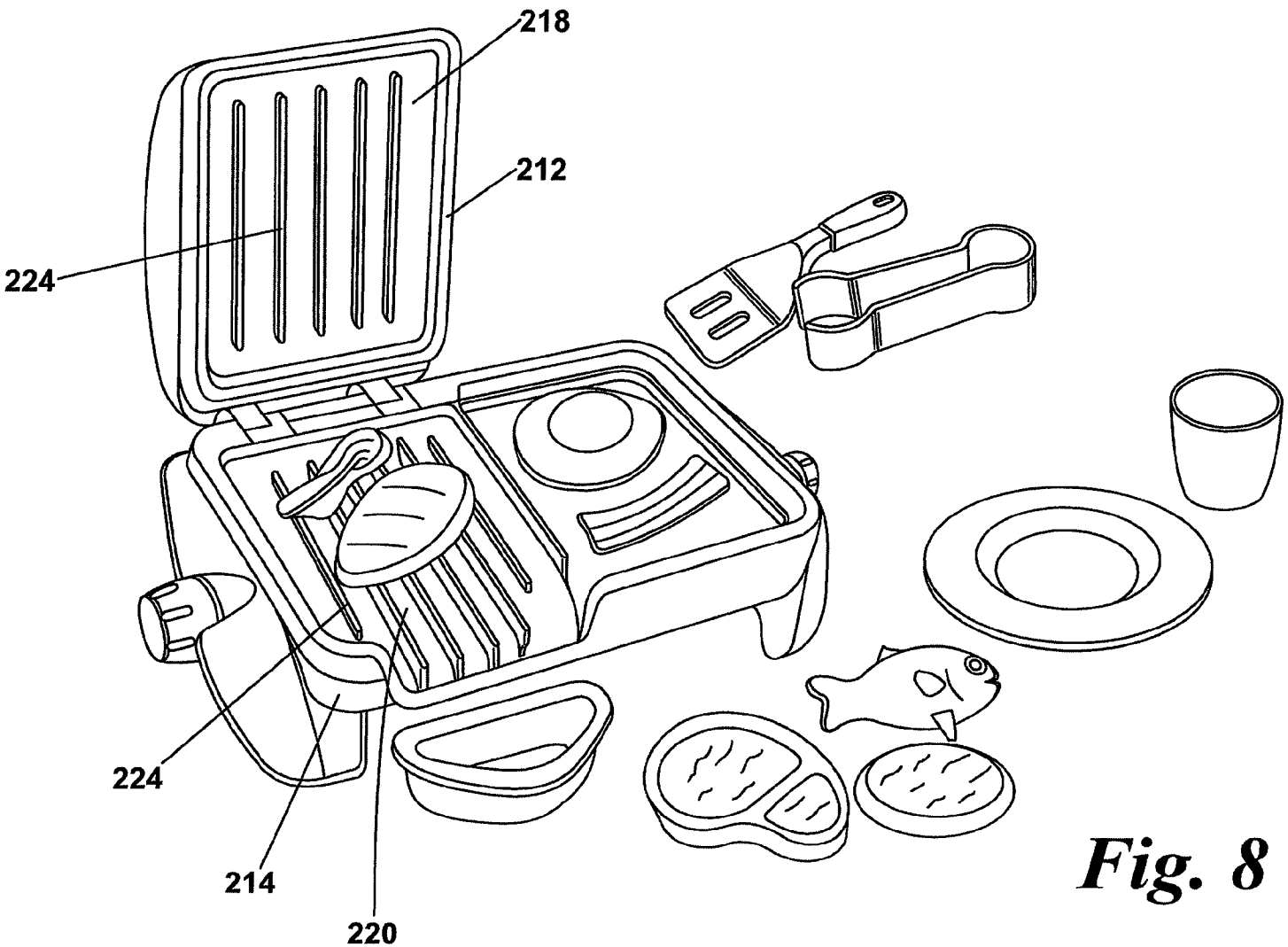
FIG. 8 shows the preferred toy grilling apparatus according to the present invention in an open arrangement.

In a preferred example illustrated exemplarily in FIGS. 7 and 8, a toy grilling apparatus 200 includes a base 214 and a lid 212 hingeably coupled to the base 214. The lid 212 preferably has an upper grilling surface 218 and the base 214 preferably has a lower grilling surface 220. Preferably, the upper grilling surface and/or the lower grilling surface include grilling ridges 224.

Preferably, the lid 212 includes a detachable vessel 240 capable of retaining a fluid, e.g. a liquid, for example water.

Preferably, the vessel 240 when coupled to the lid 212 forms a conduit which permits fluid contained within the vessel 240 to be communicated to the lower grilling surface 220. For example, when (preferably detachably) coupled to the lid 212, a conduit may couple with a corresponding conduit in the lid, and thus may be capable of communicating fluid from within the vessel 240 to the upper grilling surface 218, wherein the upper grilling surface 218 may include one or more apertures via which fluid may pass to be communicated onto the lower grilling surface 220.

Figure 9:
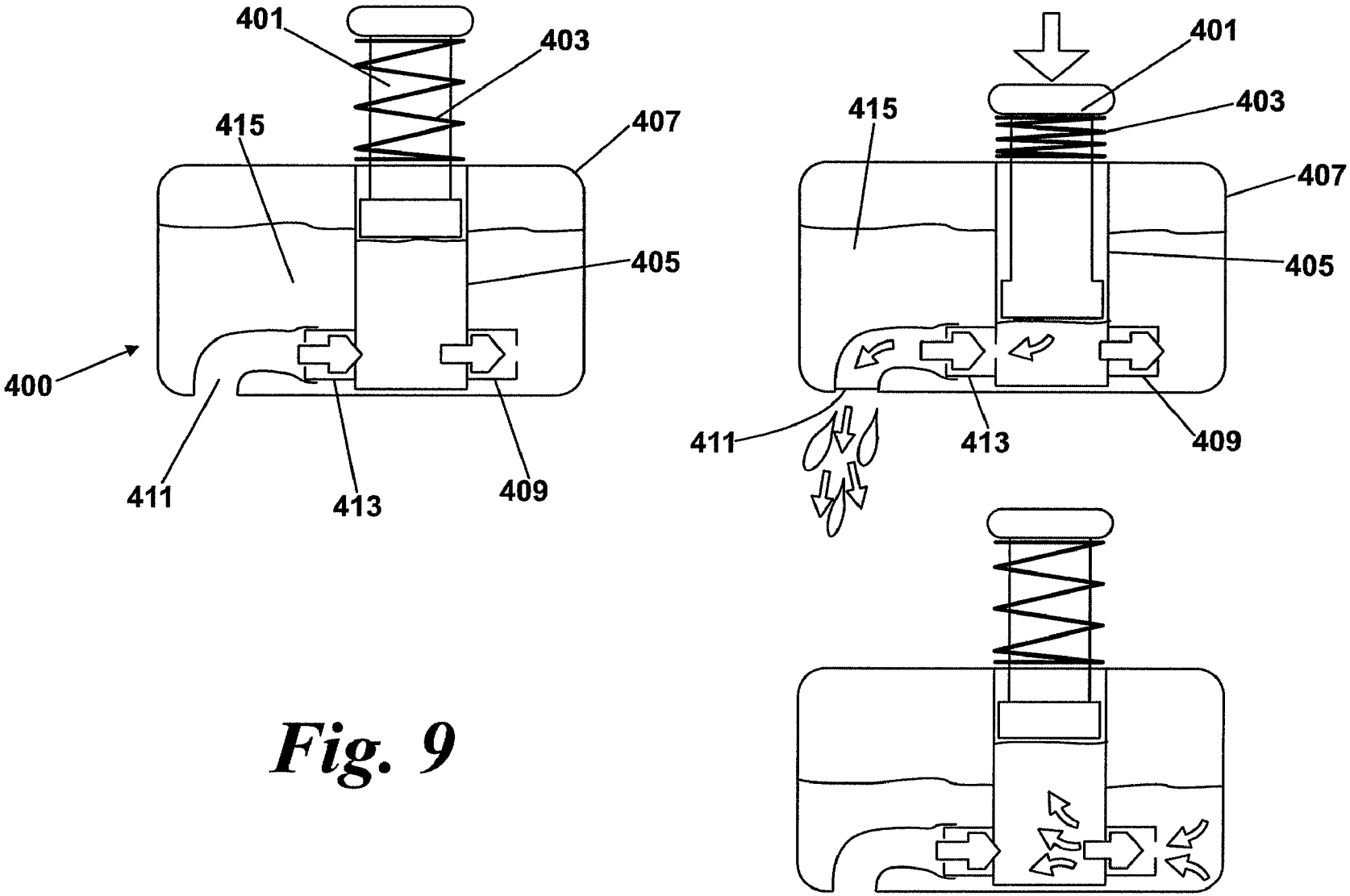
FIG. 9 shows a preferred fluid expelling mechanism for use in a toy grilling apparatus according to the present invention.

Means 400 for urging the fluid in the vessel 240 to be expelled therefrom may be included. For example, FIG. 9 shows a preferred means for doing this. For example, the means may include a plunger 401 and a return means such as a spring 403, wherein the plunger 401 is movable, e.g. slideable, in an internal chamber 405 which itself is housed within a tank 407. The internal chamber 405 is in fluid communication with the interior of the tank 407 via an inlet valve means 409. Furthermore, the internal chamber 405 is in fluid communication with an outlet aperture 411 via an outlet valve 413. A fluid 415, e.g. water, is retainable within the tank 407 and within the internal chamber 405. The internal chamber 405 is immersed in the fluid within the tank 407. Depressing the plunger 401 results in a reduction in the volume of the internal chamber 405 and consequently the contents of the chamber are expelled through the outlet valve 413 to the outlet aperture 411. The fluid does not exit via the inlet valve 409 because the inlet valve 409 is a non-return valve. However, when the plunger 401 is released, the spring 403 can urge the plunger to its rest position increasing the volume of the internal chamber 405. Consequently, water is drawn through the inlet valve 409 from the tank 407. This fills the internal chamber 405 with fluid. Also, as the volume in the internal chamber 405 is increased when the plunger 401 is returned to its rest position by the spring 403, air is not allowed to ingress to the internal chamber 405 via the outlet valve 413 because the outlet valve 413 is a non-return valve.

The means 400 may be included in the detachable vessel 240, e.g. as shown by way of example in FIG. 7.

The preferred toy grilling apparatus 200, or indeed any toy grilling apparatuses according to the present invention, may include means 500 for altering the angle of incline of the lower grilling surface 220 relative to a level surface on which the toy grilling apparatus is situated, in order to provide control over the rate of flow of fluid on the lower grilling surface 220.

Furthermore, any of the examples and/or embodiments described here may include means for generating a sound which simulates the "sizzle" sound of a food item being grilled.

Indeed, a plurality of such means may be provided, one for a toy grilling apparatus being of a clam-shell type, e.g. a health grill type, and another for a griddle type extension to a toy grilling apparatus. For example, as is shown in FIGS. 7 and 8.

The foregoing description of the preferred embodiments of the invention have been presented for purposes of illustration and description, it is not intended to be exhaustive or to limit the invention to the precise form disclosed, and modifications and variations are possible in light of the above teachings.

It is intended that the scope of the invention be defined by the claims appended hereto.

The following statements provide general expressions of the disclosure herein.

A. A toy grilling apparatus including a grill base having a grilling surface;

a grill lid, the grill lid and grill base being movable relative to one another to be brought together into a grilling arrangement; and a reservoir capable of retaining fluid; wherein when the grill base and grill lid are in the grilling arrangement fluid is able to be expelled from the reservoir to flow on the grilling surface.

B. A toy grilling apparatus according to statement A wherein the reservoir includes a fluid retaining vessel, at least partly defined by a plurality of vessel walls.

C. A toy grilling apparatus according to statement B wherein the fluid retaining vessel is detachably couplable to the grill lid.

D. A toy grilling apparatus according to statement B wherein the fluid retaining vessel is detachably couplable to the grill base.

E. A toy grilling apparatus according to statement B wherein the fluid retaining vessel is formed integrally with the grill lid.

F. A toy grilling apparatus according to statement B wherein the fluid retaining vessel is formed integrally with the grill base.

G. A toy grilling apparatus according to any one of the preceding statements.

further including expelling means for urging fluid in the reservoir to be expelled from the reservoir.

H. A toy grilling apparatus according to statement G wherein the expelling means includes pumping means operable to pump fluid from the reservoir, the fluid thereby being expelled from the reservoir.

I. A toy grilling apparatus according to statement H wherein the pumping means is operable to pump fluid from the reservoir only when the grill lid and base are in the grilling arrangement.

J. A toy grilling apparatus according to statement H or I wherein the pumping means includes an electric pump.

K. A toy grilling apparatus according to statement G wherein the expelling means includes volume reducing means for reducing a fluid retaining volume of the reservoir thereby to urge fluid in the reservoir to be expelled from the reservoir.

L. A toy grilling apparatus according to statement K wherein the volume reducing means includes a plunger movable within the reservoir to urge fluid in the reservoir to be expelled from the reservoir.

M. A toy grilling apparatus according to statement L wherein the plunger is associated with the grill lid and/or the grill base such that relative movement of the grill lid and grill base into the grilling arrangement results in a corresponding movement of the plunger to urge fluid in the reservoir to be expelled from the reservoir.

N. A toy grilling apparatus according to statement L wherein the plunger is directly movable within the reservoir by a user.

O. A toy grilling apparatus according to statement K wherein the volume reducing means includes a compressible member, compression of the compressible member being capable of urging fluid retained within the reservoir to be expelled from the reservoir.

P. A toy grilling apparatus according to statement O wherein the compressible member is associated with the grill lid and/or the grill base such that relative movement of the grill lid and grill base into the grilling arrangement results in a corresponding compression of the compressible member to urge fluid in the reservoir to be expelled from the reservoir.

Q. A toy grilling apparatus according to statement O wherein the compressible member is directly compressible by a user.

R. A toy grilling apparatus according to statement A wherein the reservoir includes a compressible body capable of retaining fluid, compression of the compressible body urging fluid retained by the compressible body to be expelled therefrom.

S. A toy grilling apparatus according to statement R wherein the compressible body is formed of an absorbent material.

T. A toy grilling apparatus according to statement R or S wherein the compressible body is formed of a sponge-like material.

U. A toy grilling apparatus according to any one of statements R to T wherein the compressible body is locatable between the grill base and grill lid to rest on the grilling surface, the compressible body being compressed between the grill lid and the grill base when they are put in the grilling arrangement.

V. A toy grilling apparatus according to statement U wherein the compressible body is couplable to the grilling surface to represent a grilling ridge on the grilling surface.

W. A toy grilling apparatus according to any one of statements R to U wherein the compressible body is couplable to a grilling surface provided on said grill lid to represent a grilling ridge thereon, the respective grilling surfaces of the grill lid and the grill base substantially facing each other when the grill toy is put in the grilling arrangement.

X. A toy grilling apparatus according to any one of statements R to T wherein the compressible body is receivable in the grill base to be sandwiched between a grill base floor and a grill base grilling body which includes the grilling surface, the grill base grilling body being movable relative to the grill base floor to compress the compressible body.

Y. A toy grilling apparatus according to statement X wherein the grill base grilling body is only movable relative to the grill base floor when the grill base and the grill lid are in the grilling arrangement.

Z. A toy grilling apparatus according to any one of statements R to T wherein the compressible body is receivable in the grill lid to be sandwiched between a grill lid ceiling and a grill lid grilling body which includes a grill lid grilling surface, the grill lid grilling body being movable relative to the grill lid ceiling to compress the compressible body.

ZA. A toy grilling apparatus according to statement Z wherein the grill lid grilling body is only movable relative to the grill lid ceiling when the grill base and the grill lid are in the grilling arrangement.

ZB. A toy grilling apparatus according to any one of the preceding statements further including a first conduit via which fluid in the reservoir can be communicated to the grilling surface.

ZC. A toy grilling apparatus according to statement ZB wherein the first conduit includes one or more apertures formed in the grill lid for communicating the fluid to the grilling surface.

ZD. A toy grilling apparatus according to any one of statements A to ZA wherein the grill base is configured to provide a second conduit via which fluid in the reservoir can be communicated to the grilling surface.

ZE. A toy grilling apparatus according to statement ZB or ZD wherein the or each conduit includes one or more apertures formed in the grill base for communicating the fluid to the grilling surface.

ZF. A toy grilling apparatus according to statement ZE wherein the or each aperture is formed in the grilling surface.

ZG. A toy grilling apparatus according to any one of statements ZB to ZF wherein the or each conduit includes a valve for controlling the flow of fluid from the reservoir to the grilling surface via the conduit.

ZH. A toy grilling apparatus according to statement ZG wherein the or each valve is capable of preventing the flow of fluid from the reservoir to the grilling surface via the conduit when the grill base and the grill lid are in an arrangement other than the grilling arrangement.

ZI. A toy grilling apparatus according to statement ZG or ZH, wherein the or each valve includes a check valve, operable to allow fluid from the reservoir to be communicated via the conduit to the grilling surface when the fluid pressure on the upstream reservoir side of the check valve exceeds the pressure on the downstream side of the check valve by a pre-determined amount.

ZJ. A toy grilling apparatus according to statement ZI wherein the or each check valve includes a slit valve.

ZK. A toy grilling apparatus according to any one of the preceding statements wherein the grill base includes one or more support elements for supporting the toy grilling apparatus on a surface, and wherein the grilling surface is formed such that when the toy grilling apparatus is arranged on a level surface, the grilling surface is inclined relative to the level surface.

ZL. A toy grilling apparatus according to statement ZK wherein the one or more support elements are adjustable to adjust the degree of inclination of the grill surface.

ZM. A toy grilling apparatus according to statement ZK or ZL, further including a rotatable cam, rotation of the cam being capable of adjusting the degree of inclination of the grill surface.

ZN. A toy grilling apparatus according to any one of the preceding statements, including means for generating sound simulating the sound of grilling food.

ZO. A toy grilling apparatus according to statement ZN wherein the sound generating means is configured to be operable to generate sound contemporaneously with fluid from the reservoir flowing on the grilling surface.

ZP. A toy grilling apparatus according to statement ZN or ZO wherein the sound generating means is only operable to generate sound when the grill base and the grill lid are in the grilling arrangement.

ZQ. A toy grilling apparatus according to any one of the preceding statements, wherein the grill lid and the grill base are movably coupled by a hinge.

ZR. A kit of parts including:

a grill base having a grilling surface;

a grill lid, the grill lid and grill base being couplable by a hinge to be movable relative to one another so as to be brought together into a grilling arrangement; and a reservoir capable of retaining fluid, the fluid be expellable from the reservoir to flow on the grilling surface when the grill base and grill lid are in the grilling arrangement.

ZS. A kit of parts according to statement ZR, further including a hinge for coupling the grill lid and grill base.

ZT. A kit of parts according to statement ZR or ZS, wherein the reservoir includes an absorbent material.

ZU. A kit of parts according to statement ZT wherein the absorbent material is formed of a sponge-like material.

ZV. A kit of parts according to any one of statements ZR to ZU wherein the reservoir is formed in the shape of an item of food to be grilled.

ZW. A kit of parts according to any one of statements ZR to ZU further including a drip tray suitable for being located proximate to the grilling surface to catch fluid flowing off the grilling surface.

ZX. A toy grill substantially as described herein with reference to, and as illustrated in, FIG. 1, 2, 3, 4, 5 or 6 or FIGS. 7 to 9.

The invention claimed is:

1. A toy grilling apparatus including a grill base having a grilling surface;

a grill lid, the grill lid and grill base being movable relative to one another to be brought together into a grilling arrangement; and a reservoir capable of retaining fluid; wherein when the grill base and grill lid are in the grilling arrangement fluid is able to be expelled from the reservoir to flow on the grilling surface.

2. A toy grilling apparatus according to claim 1 wherein the reservoir includes a fluid retaining vessel, at least partly defined by a plurality of vessel walls.

3. A toy grilling apparatus according to claim 2 wherein the fluid retaining vessel is detachably couplable to the grill lid or grill base.

4. A toy grilling apparatus according to claim 2 wherein the fluid retaining vessel is formed integrally with the grill lid or grill base.

5. A toy grilling apparatus according to claim 1 further including expelling means for urging fluid in the reservoir to be expelled from the reservoir.

6. A toy grilling apparatus according to claim 5 wherein the expelling means includes pumping means operable to pump fluid from the reservoir, the fluid thereby being expelled from the reservoir.

7. A toy grilling apparatus according to claim 5 wherein the expelling means includes volume reducing means for reducing a fluid retaining volume of the reservoir thereby to urge fluid in the reservoir to be expelled from the reservoir.

8. A toy grilling apparatus according to claim 7 wherein the volume reducing means includes a plunger movable within the reservoir to urge fluid in the reservoir to be expelled from the reservoir.

9. A toy grilling apparatus according to claim 7 wherein the volume reducing means includes a compressible member, compression of the compressible member being capable of urging fluid retained within the reservoir to be expelled from the reservoir.

10. A toy grilling apparatus according to claim 1 wherein the reservoir includes a compressible body capable of retaining fluid, compression of the compressible body urging fluid retained by the compressible body to be expelled therefrom.

11. A toy grilling apparatus according to claim 10 wherein the compressible body is formed of an absorbent material.

12. A toy grilling apparatus according to claim 10 wherein the compressible body is locatable between the grill base and grill lid to rest on the grilling surface, the compressible body being compressed between the grill lid and the grill base when they are put in the grilling arrangement.

13. A toy grilling apparatus according to claim 1 further including a first conduit via which fluid in the reservoir can be communicated to the grilling surface.

14. A toy grilling apparatus according to claim 13 wherein the conduit includes a valve for controlling the flow of fluid from the reservoir to the grilling surface via the conduit.

15. A toy grilling apparatus according to claim 14 wherein the value is capable of preventing the flow of fluid from the reservoir to the grilling surface via the conduit when the grill base and the grill lid are in an arrangement other than the grilling arrangement.

16. A toy grilling apparatus according to claim 14, wherein the value includes a check valve, operable to allow fluid from the reservoir to be communicated via the conduit to the grilling surface when the fluid pressure on the upstream reservoir side of the check valve exceeds the pressure on the downstream side of the check valve by a pre-determined amount.

17. A toy grilling apparatus according to claim 1 wherein the grill base includes one or more support elements for supporting the toy grilling apparatus on a surface, and wherein the grilling surface is formed such that when the toy grilling apparatus is arranged on a level surface, the grilling surface is inclined relative to the level surface.

18. A toy grilling apparatus according to claim 1, including means for generating sound simulating the sound of grilling food.

19. A kit of parts for forming a toy grill apparatus including:

a grill base having a grilling surface;

a grill lid, the grill lid and grill base being couplable by a hinge to be movable relative to one another so as to be brought together into a grilling arrangement; and a reservoir capable of retaining fluid, the fluid to be expellable from the reservoir to flow on the grilling surface when the grill base and grill lid are in the grilling arrangement.

* * * * *